United States Patent [19]

Zimmerman

[11] 4,225,130

[45] Sep. 30, 1980

[54] PORTABLE EXERCISE DEVICE

[76] Inventor: Jerrold Zimmerman, 28 Dutch Rd., East Brunswick, N.Y. 08806

[21] Appl. No.: 937,238

[22] Filed: Aug. 28, 1978

[51] Int. Cl.[3] ..... A63B 23/04; A63B 69/16

[52] U.S. Cl. ..... 272/73; 272/132; 272/900; 272/143

[58] Field of Search ..... 272/73, 900, 67, 68, 272/131, 132, 143, DIG. 4, DIG. 3, 130

[56] References Cited

U.S. PATENT DOCUMENTS

| | | | |
|---|---|---|---|
| 2,209,034 | 7/1940 | Paul | 272/73 |
| 3,013,799 | 12/1961 | Wise | 272/900 X |
| 3,062,543 | 11/1962 | Shaboo et al. | 272/68 X |
| 3,129,939 | 4/1964 | Stock | 272/68 |
| 3,224,765 | 12/1965 | Baker et al. | 272/132 |
| 3,259,385 | 7/1966 | Boren | 272/73 |
| 3,601,395 | 8/1971 | Morgan | 272/73 |
| 4,116,434 | 9/1978 | Bernstein | 272/900 |

*Primary Examiner*—Richard C. Pinkham
*Assistant Examiner*—Arnold W. Kramer
*Attorney, Agent, or Firm*—Caesar, Rivise, Bernstein & Cohen, Ltd.

[57] ABSTRACT

A portable exercise device for releasable securement to the vertical edge of a door or other vertically extending structure. The device comprises a pedal assembly, comprising an elongated axle from which a diametrically opposed pair of arms extend, with each arm having a respective pedal mounted thereon. The pedal assembly is arranged to be rotated about the longitudinal axis of the axle by the application of force to the pedals. The axle is mounted within a holder having a clamping bracket. The holder includes a tension bar and a frictional material split sleeve disposed about the axle to frictionally engage, the peripheral surface thereof. The tension bar is adjustable to vary the frictional engagement between the sleeve and the axle so that the user can select a desired amount of pedalling resistance the device will provide. Each pedal includes finger notches to enable the user to rotate the pedals by hand. Stirrups are provided to ensure that the user's feet, when rotating the pedals, do not slip off the pedals.

5 Claims, 4 Drawing Figures

FIG. 3
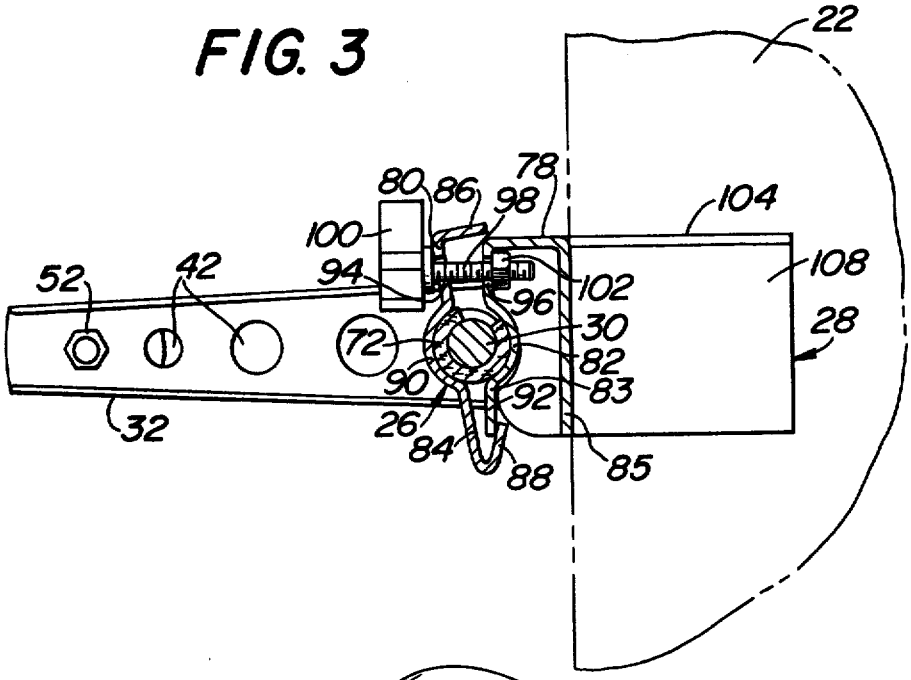
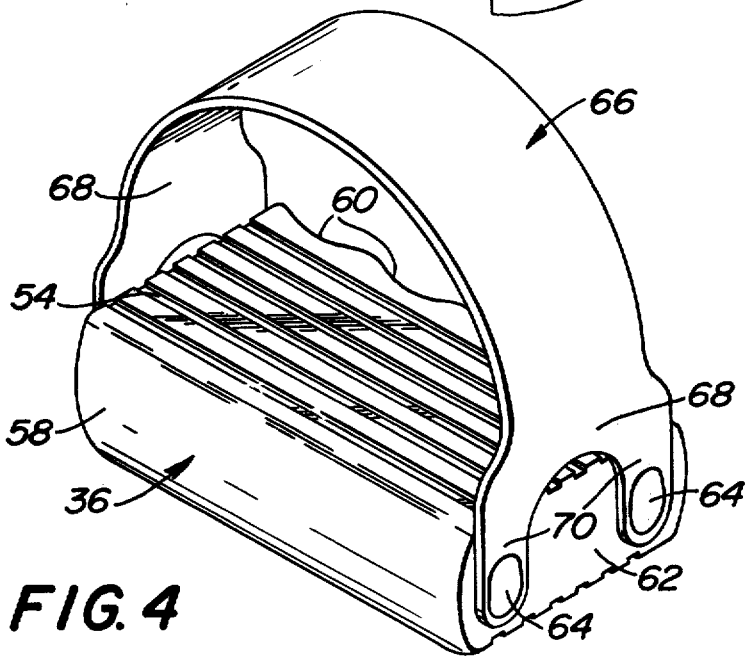
FIG. 4

PORTABLE EXERCISE DEVICE

This invention relates to exercise devices, and more particularly to portable exercise devices.

In recent years there has been an increasing emphasis on physical fitness. Pedalling against a resistance, such an encountered during bicycle riding, is a particularly effective mode of physical exercise. In order to enable one to gain the benefits of pedalling without requiring one to go outdoors, various stationary bicycle exercise devices are commercially available. While such devices provide a viable means of indoor exercise, such devices suffer from one or several drawbacks. Among the major drawbacks are size, cost, portability, complexity, etc.

Accordingly, it is a general object of the instant invention to provide a portable exercise device which overcomes the disadvantages of the prior art.

It is a further object of the instant invention to provide a portable exercise device which can be readily mounted on a vertically extending support member, such as a door edge.

It is a further object of the instant invention to provide a portable exercise apparatus which can be adjusted to vary the amount of force required to use same.

It is a further object of the instant invention to provide a portable exercise apparatus which can be used to exercise one's arms as well as one's legs.

These and other objects of the instant invention are achieved by providing a portable exercise device comprising a holder, clamping mounting means therefore and a pedal assembly. The pedal assembly comprises an axle having a pair of diametrically opposed arms mounted on opposite ends of the axle, with each of the arms having a pedal mounted thereon which is rotatable about an axis parallel to the axis of the axle. The pedal assembly is mounted in the holder and is arranged for rotation about the longitudinal axis of the axle by the application of force on the pedals. The holder includes frictional engagement means which coacts with the surface of the axle to provide resistance to the rotation of the axle about its longitudinal axis. The clamping means is arranged for releasably securing the device onto a vertically extending member, such as a door edge.

Other objects and many of the attendant advantages of the invention will be readily appreciated as the same becomes understood by reference to the following detailed description when considered in connection with the accompanying drawings wherein:

FIG. 3 is an enlarged sectional view taken along line 3—3 of FIG. 1; and

FIG. 4 is an enlarged perspective view of the pedal shown in FIG. 1 but including an accessory stirrup mounted thereon.

Figure 1:
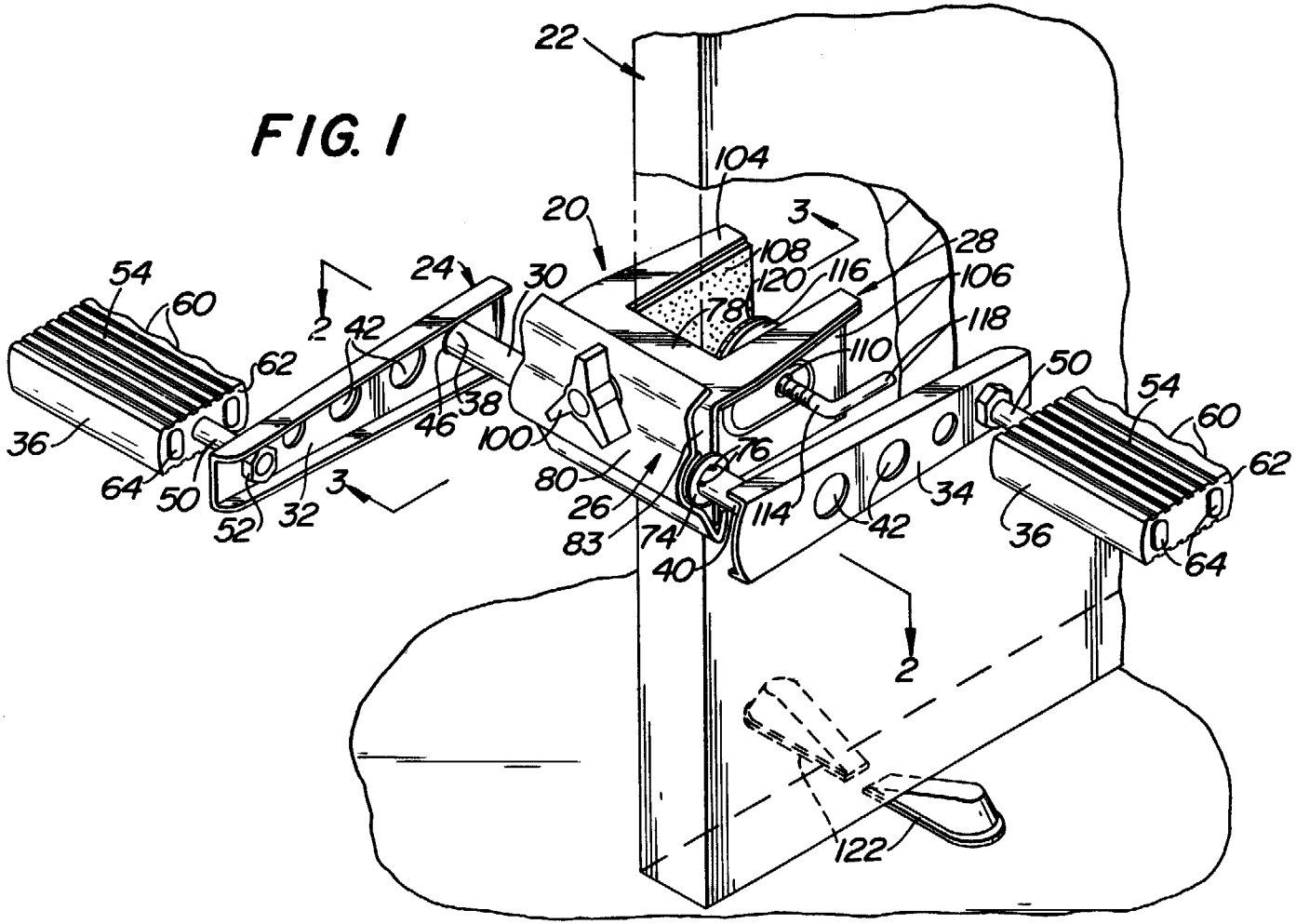
FIG. 1 is a perspective view of the portable exercise device of the instant invention when mounted on a vertically extending door.

Referring now to the various figures of the drawing wherein like reference characters refer to like parts there is shown in FIG. 1 a portable exercise device 20 of the instant invention shown in a typical mounting arrangement secured to the vertical edge of a door 22.

The device 20 basically comprises a pedal unit 24, a body or holder assembly 26, and clamping means 28. The pedal unit comprises a elongated axle 30 a diametrically opposed pair of radially extending arms 32 and 34 mounted on each end of the axle, with each arm mounting a pedal 36 thereon.

The pedal assembly 30 is arranged to be rotated about the longitudinal axis of the axle 30 by the application of force to the pedals 36. The holder 26 and the clamping means 28 are connected together and serve to hold the pedal unit on a vertically extending support above the floor for use.

The details of the holder assembly 26 will be considered in detail later, suffice for now to state that the holder includes means for adjusting the amount of resistance applied to the axle as it is rotated about its longitudinal axis by the pedalling action. This feature is of considerable importance since it enables the user to adjust the device 20 to provide the desired amount of physical exertion.

Figure 2:
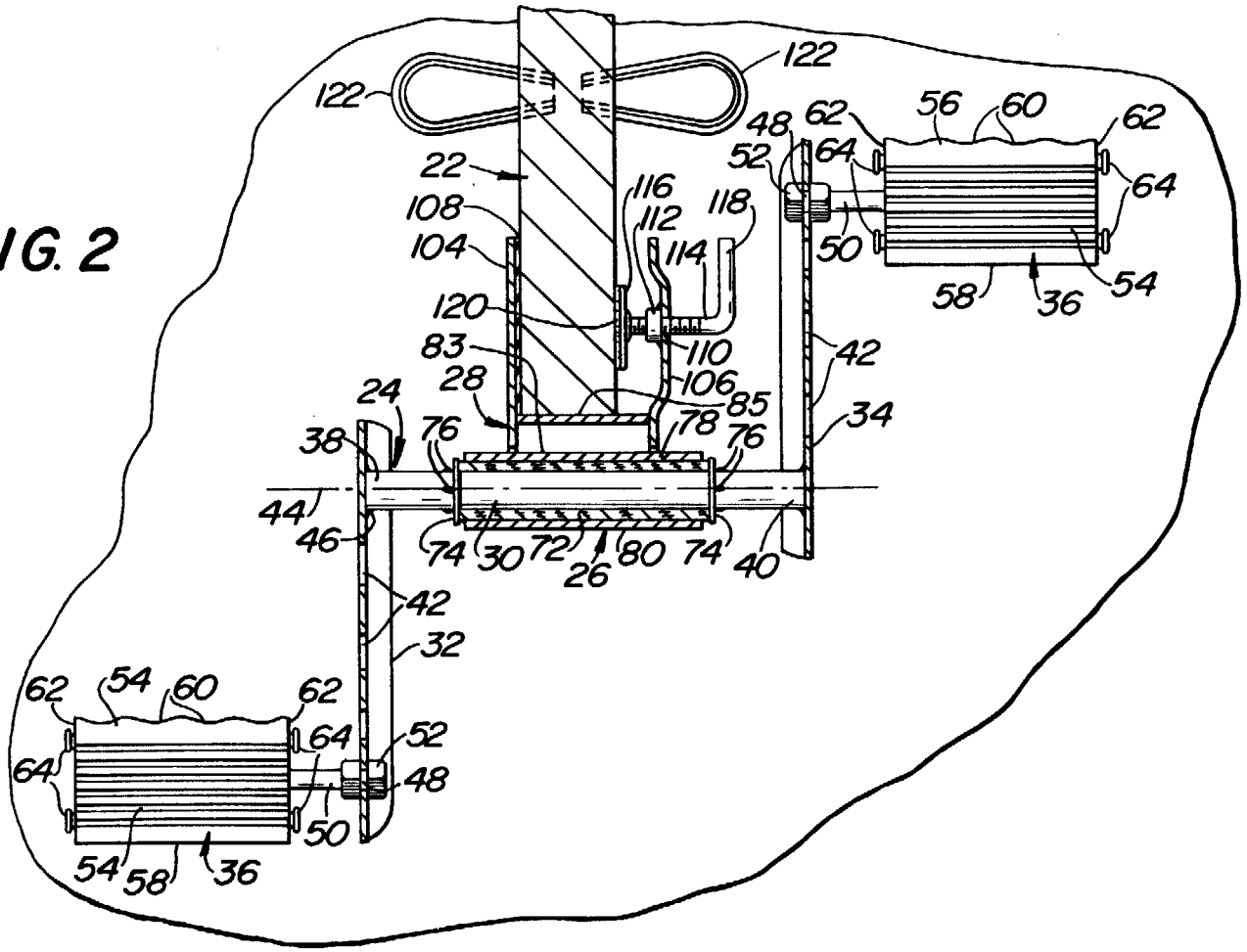
FIG. 2 is a sectional view taken along line 2—2 of FIG. 1.

Referring now to FIGS. 1 and 2 the axle 30 is seen to comprise a solid rod or shaft having a first end 38 and a second end 40. The arms 32 and 34 are of identical construction. Accordingly, only 32 will be described herein. As can be seen, arm 32 is a generally channel-shaped member having a plurality of weight reducing holes 42 in the web portion thereof. The arm 32 is mounted so that its longitudinal axis extends radially to the longitudinal axis of the axle 30. The longitudinal axis of the axle is shown schematically in FIG. 2 and identified by the reference numeral 44. The securement of the arm 32 to the axle end 38 is accomplished by a welded or brazed joint 46. The arm 34 extends in the opposite radial direction to arm 32 and is welded to the end 40 of axle 30 by a similar weld or brazed joint 46. The free end of each arm 32 and 34 includes an opening 48.

Each pedal 36 is of generally conventional construction and is in the form of a block or slab having a longitudinally extending opening in which a axle 50 is disposed. Each pedal is freely rotatable about its axle 50. Each axle 50 includes a threaded end which extends through the opening 48 in the associated arm 32 and 34. A nut 52 is threadedly engaged on the threaded end of the axle 50 to secure the axle on the free end of the arm, with the axis of rotation of the pedal being parallel to the axis of rotation of the axle 30. Each pedal also includes an opposed pair of ribbed contact surfaces 54, either of which is adapted to be engaged by the user's foot, and a pair of side surfaces 56 and 58. As can be seen side surface 56 includes a plurality of depressions or indentations 60. The indentations are provided to receive a user's fingers so that the apparatus can be used to exercise one's arms by gripping the pedals with one's hands. Each pedal also includes two end surfaces 62 each including a pair of catches 64 projecting therefrom. The catches are provided to enable a stirrup 66 (FIG. 4) to be secured to each pedal. The stirrups 66 are mounted on the pedals when the apparatus 20 is pedalled by foot to prevent the user's feet from slipping off the pedals.

As can be seen in FIG. 4 each stirrup is a generally U-shaped member having an opposed pair of ends 68. Each end 68 includes a pair of fingers 70 extending therefrom. Each finger 70 includes an opening (not shown) through which the head of an associated catch 64 extends to secure a stirrup in place. Each stirrup can be readily removed from its pedal by removing each catch from its associated opening.

As noted heretofore the holder assembly 26 includes means for adjusting the amount of friction applied to the axle 30 so that the user can adjust the device to provide the amount of physical exertion desired. The friction adjusting means basically comprises a split sleeve 72, formed of a frictional, e.g., fibrous, material. The sleeve 72 is mounted in the holder assembly 26 and surrounds the midportion of the axle 30. A pair of stop washers 74 are mounted on the axle 30 at opposite ends of the sleeve 72. The stop washers 74 are held in place by a plurality of projections or nibs 76 extending at equidistantly spaced locations about the periphery of the axle.

The holder assembly 26 is shown clearly in FIGS. 1 and 3 and comprises a base member 78 and a tension bar 80. The base member 78 includes an elongated convex recess 82 in the front face 83 thereof extending the full width of the front face. The base member 78 also includes a planar, vertically disposed rear face 85 (FIGS. 2 and 3). The tension bar 80 includes a web portion 84 having a generally normally projecting flange 86 extending along the entire top edge thereof, an acute angularly projecting flange 88 extending along the entire bottom thereof and an elongated convex recess 90 extending the full width thereof. The acute angularly extending flange 88 is arranged to abut the bottom edge 92 of the base member 78. The web 84 of the tension bar 78 includes an opening 94 while the base member 78 includes an opening 96 aligned with the opening 94. A clamping bolt 98 extends through the aligned openings 94 and 96. The bolt 98 includes a handle 100 fixedly secured to the head thereof. A nut 102 is threadedly engaged on the bolt to hold the bolt in place through the aligned holes 94 and 96.

The opposed recesses 82 and 89 form a channel therebetween in which the split ring 72 is located. The axle 30 extends through the central passageway of the split ring 72.

As should be appreciated by those skilled in the art by tightening the bolt 98, via the rotation of its handle 100, the tension bar 80 is brought toward base 78. This action squeezes the split ring more tightly about the periphery of the axle 30 extending therethrough. Accordingly, greater frictional engagement is made between the surface of the axle and the sleeve, whereupon greater force is necessary to be applied to the pedals to effect rotation of the pedal unit. Conversely, loosening the bolt 98 results in a decreasing of the frictional engagement between the sleeve and the axle so that less force is necessary to be applied to the pedals to rotate the pedal unit.

The clamping means 28, as noted heretofore is provided to secure the device 20 onto a door 22 or other vertically extending member and is connected to the holder assembly 26. To that end the clamping means 28 basically comprises a pair of legs 104 and 106 projecting rearwardly from the base 78. The leg 104 includes a vertically disposed planar, door engaging surface 108 in the form of a resilient material pad to prevent marring of the surface of the door. The opposed leg 106 includes an opening 110 and a collar 112 secured thereto and including a threaded opening aligned with opening 110. An adjustible clamping shoe 114 extends through the threaded opening in collar 112 and terminates at its free end in a door engaging disc 116. The opposite end of shoe 114 is in the form of a normally extending lever 118. As will be appreciated by those skilled in the art, the rotation of lever 118 causes the contact shoe 116 to engage the underlying surface of the door to tightly clamp the door between it and the resilient pad 108 of leg 104. In order to prevent marring of the surface of the door by the disc 116 a resilient pad 120 is mounted on the underside of the disc.

Operation of the device 20 is as follows: The device is mounted on the edge of a door, or other vertical surface, approximately six inches above the floor by fitting the door edge between the contact disc pad 120 and the contact surface 108 and with the edge of the door 22 abutting the rear face 85 of the clamping means 28. The contact shoe 114 is tightened by rotating its lever 118 until the door is tightly engaged between surface 120 and surface 108. The user than adjusts the amount of resistance to be applied to the axle 30 by either tightening or loosening the tension bar 80, via rotation of handle 100. Once the resistance bar has been adjusted as desired, the device is ready for use. To that end the user can either sit on a low stool while placing his feet in the stirrups 66 and on the pedals 36 or can lie on his back on the floor placing his feet on the pedals. If the vertical member on which device 20 is mounted is a door, it is recommended that a pair of wedged stops 122 be inserted under the lower edge of the door on opposite sides thereof to prevent pivoting of the door during use of the device.

The device 20 can also be used to exercise one's arms by removing the stirrups 64 and grasping each pedal in one's hand, with the fingers of each hand being disposed within the finger grooves 60 in the edge of the pedal. For arm exercising the device should be mounted on the door at approximately shoulder height.

After use the device 20 can be removed from the door by unloosening the clamping shoe 114. Since the device is compact it can be easily stored away until it is to be used again.

As should be appreciated from the foregoing the portable exercise device of the instant invention is simple in contruction, compact, readily portable and is adapted for mounting on various types of vertical surfaces. In addition, the device provides a wide range of use since it can be adjusted to provide various degrees of physical exertion and can be used to exercise a user's arms as well as his legs.

Without further elaboration, the foregoing will so fully illustrate my invention that others may, by applying current or future knowledge, readily adapt the same for use under various conditions of service.

What is claimed as the invention is:

1. A portable device for exercising a person's arms or legs and arranged for releasable securement to the vertical edge of a door comprising a holder assembly, mounting means therefor and a pedal assembly, said pedal assembly comprising an axle having a pair of diametrically opposed arms mounted on opposite ends of said axle, with each of said arms including a pedal mounted thereon, each of said pedals being rotatable about an axis parallel to the longitudinal axis of said axle and including a surface having plural indentations configured to receive a person's fingers, said mounting means forming a clamping assembly comprising a base member having a rear face, a front face having legs projecting rearwardly therefrom, tensioning means, and frictional engagement means, said front face including a first horizontal recess, said tensioning means including a second horizontal recess disposed opposite to said first recess, said recesses defining a channel therebetween in which said frictional engagement means is located for mounting and supporting said pedal assembly for rotation about the longitudinal axis of said axle by the application of force to said pedals, said frictional engagement means coacting with the peripheral surface of said axle to provide resistance to the rotation of said pedal assembly about the longitudinal axis of said axle, with the amount of resistance being established by adjustment of said tensioning means, said mounting means releasably securing said device on the door with the rear face of said base member abutting the edge of the door and with portions of the door contiguous with said edge being clamped between said legs, whereupon the horizontal axle of the pedal assembly is parallel to the vertical edge and with each pedal being located on a respective side of the door.

2. The device of claim 1 wherein said frictional engagement means conprises a sleeve, formed of frictional material and said axle extending through said sleeve.

3. The device of claim 2 wherein said sleeve is formed of a fibrous material.

4. The device of claim 2 wherein said holder also comprises threaded means for adjusting the spacing between said recesses to adjust the frictional engagement between said sleeve and the peripheral surface of said axle.

5. The device of claim 4 wherein each of said pedals includes a releasably securable stirrup.

* * * * *